US008127845B2

(12) United States Patent
Assal

(10) Patent No.: US 8,127,845 B2
(45) Date of Patent: Mar. 6, 2012

(54) METHODS AND SYSTEMS FOR COMPLETING MULTI-ZONE OPENHOLE FORMATIONS

(75) Inventor: Anwar Ahmed Maher Assal, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/338,748

(22) Filed: Dec. 18, 2008

(65) Prior Publication Data

US 2009/0159279 A1 Jun. 25, 2009

Related U.S. Application Data

(60) Provisional application No. 61/014,974, filed on Dec. 19, 2007.

(51) Int. Cl.
*E21B 43/04* (2006.01)

(52) U.S. Cl. ..... 166/278; 166/157; 166/227; 166/51

(58) Field of Classification Search ..... 166/278, 166/157, 227, 51, 56; 340/854.3, 854.6
See application file for complete search history.

(56) References Cited

U.S. PATENT DOCUMENTS

| | | | | |
|---|---|---|---|---|
| 6,298,916 | B1 * | 10/2001 | Tibbles et al. | 166/278 |
| 6,343,651 | B1 | 2/2002 | Bixenman | |
| 6,446,729 | B1 | 9/2002 | Bixenman et al. | |
| 7,066,264 | B2 * | 6/2006 | Bissonnette et al. | 166/305.1 |
| 2003/0070809 | A1 * | 4/2003 | Schultz et al. | 166/278 |
| 2007/0227727 | A1 | 10/2007 | Patel et al. | |
| 2008/0164027 | A1 | 7/2008 | Sanchez | |
| 2008/0314589 | A1 * | 12/2008 | Guignard et al. | 166/278 |
| 2009/0095471 | A1 | 4/2009 | Guignard et al. | |

* cited by examiner

*Primary Examiner* — William P Neuder
*Assistant Examiner* — Yong-Suk Ro
(74) *Attorney, Agent, or Firm* — Robb D. Edmonds; David G. Matthews; Rodney Warfford

(57) ABSTRACT

Methods and systems for completing multi-zone formations. The method can include placing a gravel pack assembly within a borehole. The gravel pack assembly can include a first sand control extension. A first sand control screen can be disposed adjacent the first sand control extension. The first sand control extension can have a flowpath that is selectively opened and closed. A first isolation packer can be disposed adjacent the first sand control screen. A second isolation packer can be disposed adjacent the first isolation packer. A second sand control extension can be disposed adjacent the second isolation packer. The second sand control extension can include at least a second flowpath that is selectively opened and closed. A second sand control screen can be disposed adjacent the second sand control extension. A lower seal can be disposed adjacent the second sand control screen.

14 Claims, 4 Drawing Sheets

METHODS AND SYSTEMS FOR COMPLETING MULTI-ZONE OPENHOLE FORMATIONS

CROSS-REFERENCE TO RELATED APPLICATIONS

This application claims priority to U.S. Provisional Patent Application having Ser. No. 61/014,974, filed on Dec. 19, 2007, which is incorporated by reference herein.

BACKGROUND

Hydrocarbon producing formations typically have sand commingled with the hydrocarbons to be produced. For various reasons, it is not desirable to produce the commingled sand to the earth's surface. Thus, sand control completion techniques are used to prevent the production of sand.

A commonly used sand control technique is a gravel pack. Gravel packs typically utilize a screen or the like that is lowered into the borehole and positioned adjacent a hydrocarbon producing zone, which is to be completed. Particulate material, collectively referred to as "gravel," is then pumped as slurry into the borehole. The liquid in the slurry flows into the formation and/or through the openings in the screen resulting in the gravel being deposited in an annulus formed in the borehole between the screen and the borehole. The gravel forms a permeable mass or "pack" between the screen and the producing formation. The gravel pack allows flow of the produced fluids therethrough while substantially blocking the flow of any particulate material, e.g. sand.

In openhole completions that are gravel packed, a drilling fluid residue is often left on the formation adjacent to the borehole in the form of a filter cake, which must be removed to produce the adjacent formation. Filter cake removal treatments are conventionally done through coiled tubing after gravel packing is complete. To remove the filter cake, the gravel pack tubing is removed from the borehole and the coiled tubing for filter cake removal is run-in. Breakers, acids or other chemicals are pumped through the coiled tubing into the borehole to remove the filter cake. After the filter cake is removed, the coiled tubing is removed from the borehole and the final production/injection tubing is then run in.

Such repetitive steps of running and removing multiple work strings into the well is extremely time consuming and costly. It is even more time consuming and costly for completing boreholes with multiple producing zones within the same formation because each zone is typically completed and produced one at a time. It is highly desirable to complete all zones in a single trip.

There is a need, therefore, for new systems and methods for gravel packing that reduce the number of trips downhole needed to gravel pack multi-zone wells.

SUMMARY

Methods and Systems for completing multi-zone formations are provided. One or more embodiments can include a gravel pack assembly. The gravel pack assembly can have a first sand control extension. A first sand control screen can be disposed adjacent the first sand control extension. A first isolation packer can be disposed adjacent the first sand control screen. A second isolation packer can be disposed adjacent the first isolation packer. A second sand control extension can be disposed adjacent the second isolation packer. A second sand control screen can be disposed adjacent the second sand control extension. A third isolation packer can be disposed adjacent the second sand control screen. A fourth isolation packer can be disposed adjacent the fourth isolation packer. A third sand control extension can be disposed adjacent the third isolation packer. A third sand control screen can be disposed adjacent the third sand control extension. A lower seal can be disposed adjacent the third sand control screen.

One or more methods for completing multi-zone formations can include locating a gravel pack assembly within a borehole. Positioning the second sand control extension and the second sand control screen at least partially within a second hydrocarbon bearing zone. Positioning the first sand control extension and the first sand control screen at least partially within a first hydrocarbon bearing zone. Setting each of the isolation packers, and pumping a gravel slurry through the second sand control extension to an annulus formed between the gravel pack assembly and a wall of the borehole. Discontinuing the pumping of the gravel slurry to the second sand control extension, and pumping the gravel slurry through the first sand control extension to the annulus.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

A detailed description of the one or more embodiments, briefly summarized above, is provided below. As used herein, the terms "up" and "down"; "upper" and "lower"; "upwardly" and "downwardly"; "upstream" and "downstream"; and other like terms are merely used for convenience to describe spatial orientations or spatial relationships relative to one another in a vertical borehole. However, when applied to equipment and methods for use in deviated or horizontal boreholes, it is understood to those of ordinary skill in the art that such terms are intended to refer to a left to right, right to left, or other spatial relationship as appropriate.

Figure 1:
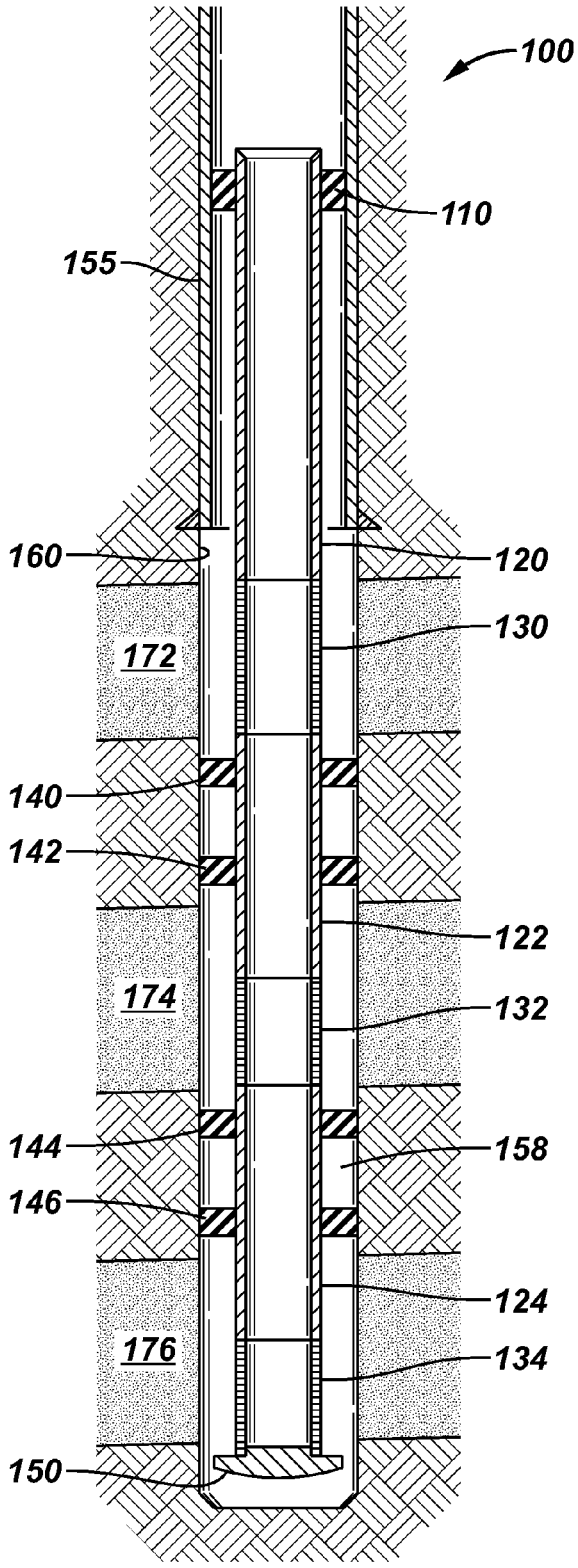
FIG. 1 depicts a schematic view of an illustrative gravel pack assembly, according to one or more embodiments described.

FIG. 1 depicts an illustrative gravel pack assembly 100, according to one or more embodiments. The gravel pack assembly 100 can include a sand control packer or hanger 110, two or more sand control extensions (three are shown 120, 122, 124), two or more sand control screens (three are shown 130, 132, 134), and two or more isolation packers (four are shown 140, 142, 144, 146). The gravel pack assembly 100 can also include a gravel pack shoe 150 disposed at an end thereof.

The isolation packers 140, 142, 144, 146 can be located at various distances along the hanger 110 or can be at least partially supported by the hanger 110 to isolate an annulus 158 formed between the gravel pack assembly 100 and the borehole 160. Preferably, each isolation packer 140, 142, 144, 146 is located between two or more sand control screens 130, 132, 134 that are each separated by one or more extensions 120, 122, 124. The sand control screens 130, 132, 134 can be spaced about or at least partially supported by the hanger 110 to be located or otherwise disposed adjacent a hydrocarbon bearing zone to be produced, and the one or more extensions 120, 122, 124 can be used to space the screens 130, 132, 134 from one another.

The sand control packer or hanger 110 can be at least partially disposed within a casing string or tubular 155 using methods well known in the art. The hanger 110 can be any packer or other device capable of attaching or otherwise affixing itself to an inner diameter of a surrounding tubular 155, such as a liner or casing as depicted in FIG. 1. The hanger 110 should also be capable of supporting the weight of the sand control screens, extensions and isolation packers.

The sand control screens 130, 132, 134 can be any type of sand control screen. For example, the sand control screens 130, 132, 134 can be a wire wrapped screen or mechanical type screen, or combinations thereof. An illustrative sand control screen is described in more detail in U.S. Pat. No. 6,725,929.

The isolation packers 140, 142, 144, 146 can be any type of packer capable of sealing off the annulus 158 between the gravel pack assembly 100 and the borehole 160. Illustrative isolation packers 140, 142, 144, 146 can include compression or cup packers, inflatable packers, "control line bypass" packers, polished bore retrievable packers, other common downhole packers, or combinations thereof.

The gravel pack shoe 150 can be attached to the bottom of the hanger 110. The gravel pack shoe 150 can be any device or member for preventing fluid from migrating further downhole. The gravel pack shoe 150 can be a lower seal, sub-packer, plug, or any other similar downhole sealing device.

The term "attached" refers to both direct attachment and indirect attachment, such as when one or more tubulars or other downhole components are disposed between the "attached" components.

Figure 2:
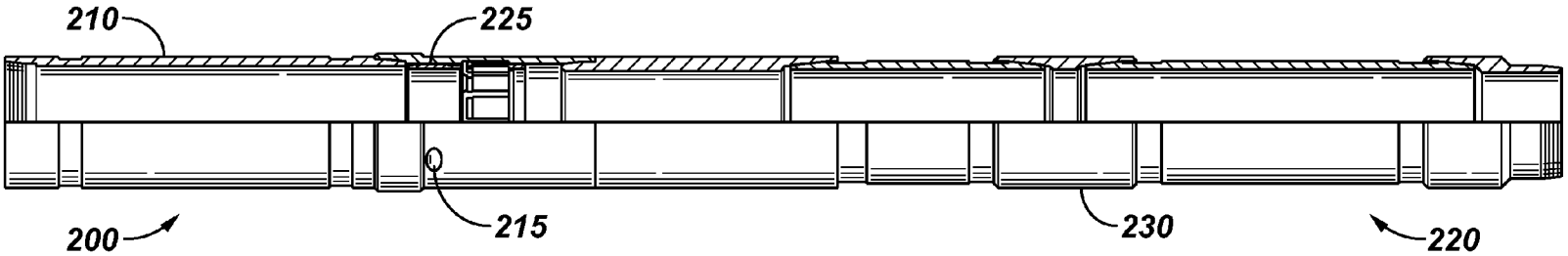
FIG. 2 depicts a cut view of an illustrative gravel pack extension, according to one or more embodiments described.

Considering the sand control extensions 120, 122, 124, FIG. 2 depicts an illustrative sand control extension 200, according to one or more embodiments. Each sand control extension 200 can include a body or inner mandrel 210 at least partially disposed within a sliding sleeve or outer housing 220. The body 210 can include one or more communication ports or openings 225 formed therethrough. The sliding sleeve 220 can also include one or more communication ports or openings 215 formed therethrough.

The one or more openings 215, 225 can be sized and configured to allow a fluid, such as gravel slurry, to flow therethrough. When the openings 215 and 225 are aligned the fluid(s) can flow from within the body 210 through the ports 215, 220 into the annulus surrounding the sand control extension 200. The sand control extension 200 is shown in a "closed" position in FIG. 2, meaning the ports 215, 225 are not aligned.

The sand control extension 200 can further include at least one set down collar 230 formed within the outer housing 220. The set down collar 230 can engage or otherwise attach to a service tool or service string (not shown). The service string can engage the set down collar 230 and can be used to pump gravel slurry into and through the sand control extension 200.

In operation, a service tool (not shown) can be used to move the outer housing 220 in relation to the inner body 210 so that the openings 215, 225 are at least partially aligned, forming a flowpath therethrough. In at least one specific embodiment, the outer housing 220 can move axially with relation to the body 210 so that the outer ports 215 can axially align with the inner ports 225, allowing passage of a fluid from within the sand control extension 200 to its outer diameter. Any sand control extension can be used, such as those commonly available from Schlumberger.

Referring again to FIG. 1, the first sand control screen 130 can be located adjacent a first hydrocarbon bearing zone 172. In at least one specific embodiment, the first sand control screen 130 can be disposed along or at least partially supported by the hanger 110 between the first sand control extension 120 and the first isolation packer 140. A second sand control screen 132 can be located adjacent a second hydrocarbon bearing zone 174. The second sand control screen 132 can be disposed along or at least partially supported by the hanger 110 between the second sand control extension 122 and isolation packers 144. The third sand control screen 134 can be located adjacent a third hydrocarbon bearing zone 176. The third sand control screen 134 can be disposed along or at least partially supported by the hanger 110 between the third sand control extension 124 and the pack shoe 150. The portions of the hanger 110 or tubing string located between the packers 140 and 142, and between the packers 144 and 146 can be predetermined based on the distances between the zones 174, 176.

Figure 3:
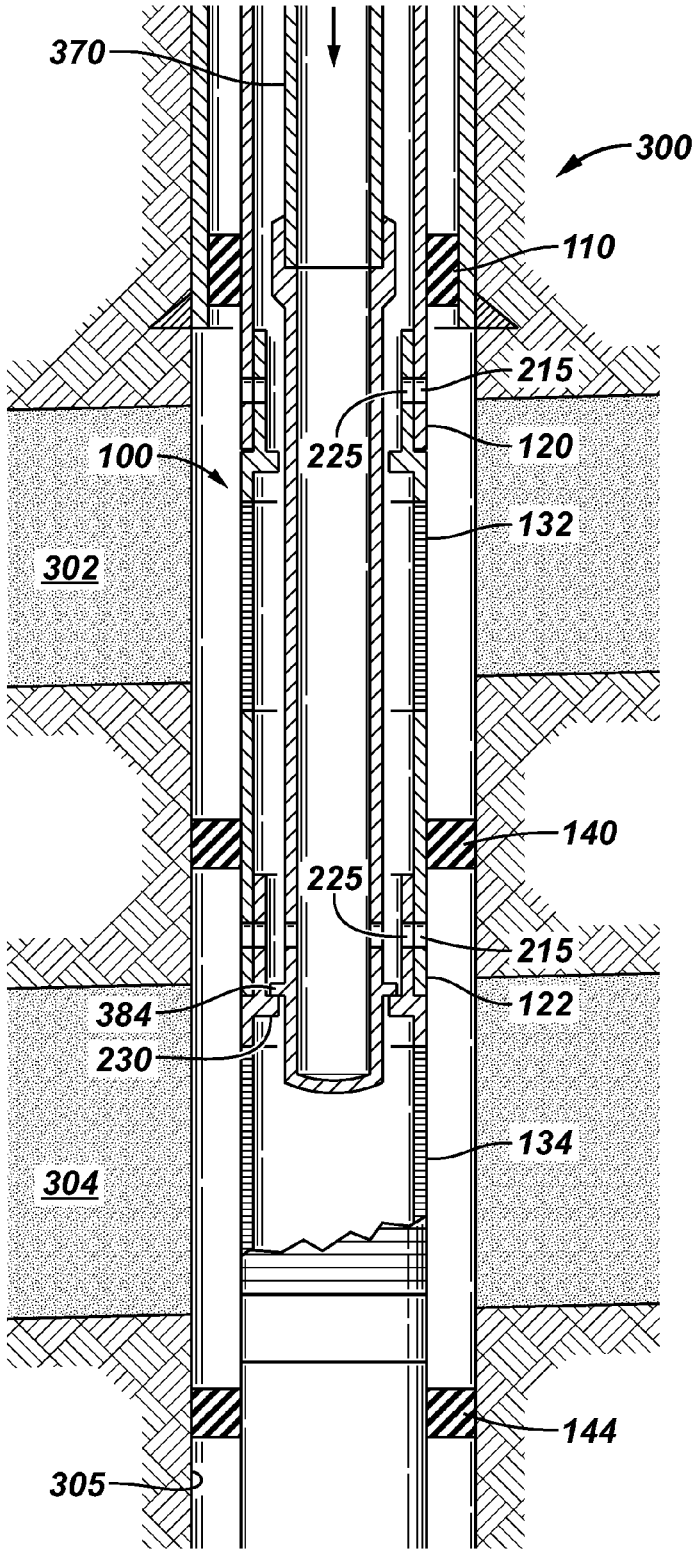
FIGS. 3 and 4 depict a schematic view of the illustrative gravel pack assembly of FIG. 1 and an illustrative service string located within a formation having multiple hydrocarbon bearing zones, according to one or more embodiments described.

FIG. 3 depicts the illustrative gravel pack assembly 100 of FIG. 1 disposed within a formation or well 300 having multiple hydrocarbon bearing zones 302, 304, according to one or more embodiments. The borehole 305 can be open, such as depicted in FIG. 3, or in the alternative, the borehole 305 can be at least partially lined or cased. The formation 300 is shown having two upper most hydrocarbon bearing zones 302, 304 where the second hydrocarbon bearing zone 304 is disposed beneath the first hydrocarbon bearing zone 302. Although shown as a vertical borehole 305, the embodiments described are equally applicable to a horizontal configuration.

As described above with reference to FIG. 1, the gravel pack assembly 100 can include the hanger 110 with two or more sand screens 132, 134, two or more extensions 120, 122, and two or more isolation packers 140, 144. The gravel pack assembly 100 can be run into the borehole 305 disposed at one end of a work or service string 370. The gravel pack assembly 100 can be run into the borehole 305 in an open-position, meaning that the openings 215, 225 of each sand control extension 120 and 122 forms an open flowpath therethrough. The service string 370 can include at least one stop 384 that is configured to engage a collar 230 of a sand control extension 120, 122, thereby allowing axial movement of the service string 370 to translate to the sliding sleeve (shown as 220 in FIG. 2) of the engaged sand control extension 120, 122.

The length of each extensions 120, 122 can be predetermined based on logging or other borehole data that determines the distance between the hydrocarbon bearing zones 302, 304, allowing the sand screens 132, 134 to be located adjacent the hydrocarbon bearing zones 302, 304 to be gravel packed. For example, the second sand control screen 134 can be aligned with or adjacent the second hydrocarbon bearing zone 304, and the first sand control screen 132 can be aligned with or adjacent the first hydrocarbon bearing zone 302.

At least one isolation packer 140 can be located between the zones 302, 304, and at least one isolation packer 144 is located beneath the second zone 304 to seal off the annulus within the borehole 305. The isolation packers 140, 144 can be set simultaneously or sequentially. Each hydrocarbon bearing zone can be isolated one by one. In one or more embodiments, the hydrocarbon bearing zones 302, 304 can be isolated zone by zone or by a grouping of two or more zones.

A grouping of zones need not consist of successive or continuous zones. Any order or pattern of zones can be grouped. In one or more embodiments, the hydrocarbon bearing zones can be isolated bottom-up or top-down.

To gravel pack the second zone 304, the service string 370 is located within the gravel assembly 100 so that the stop 384 of the service string 370 can engage the collar 230 of the second sand control extension 122. Being that the sand control extension 122 is run-in in the open-position, a fluid, e.g. gravel slurry, can then be pumped through the service string 370 and through the ports 215, 225 of the extension 122 into the surrounding annulus of the borehole 305 that is isolated about the second hydrocarbon bearing zone 304 by the packers 140, 144. Additional details can be found in U.S. Pat. No. 6,725,929.

Once the annulus is sufficiently packed off, the flow of the gravel slurry can be stopped. The service string 370 can then be moved towards the first hydrocarbon bearing zone 302. When the service string 370 is moved axially, the service string 370 translates that axial movement to the sliding sleeve 220 of the second sand control extension 122. The ports 215 and 225 are no longer aligned, closing off the flowpath through the extension 122. The service string 370 can then be positioned, in the same trip downhole, to a location adjacent the first sand control extension 120 which is located adjacent the first hydrocarbon bearing zone 302, as depicted in FIG. 4.

Figure 4:
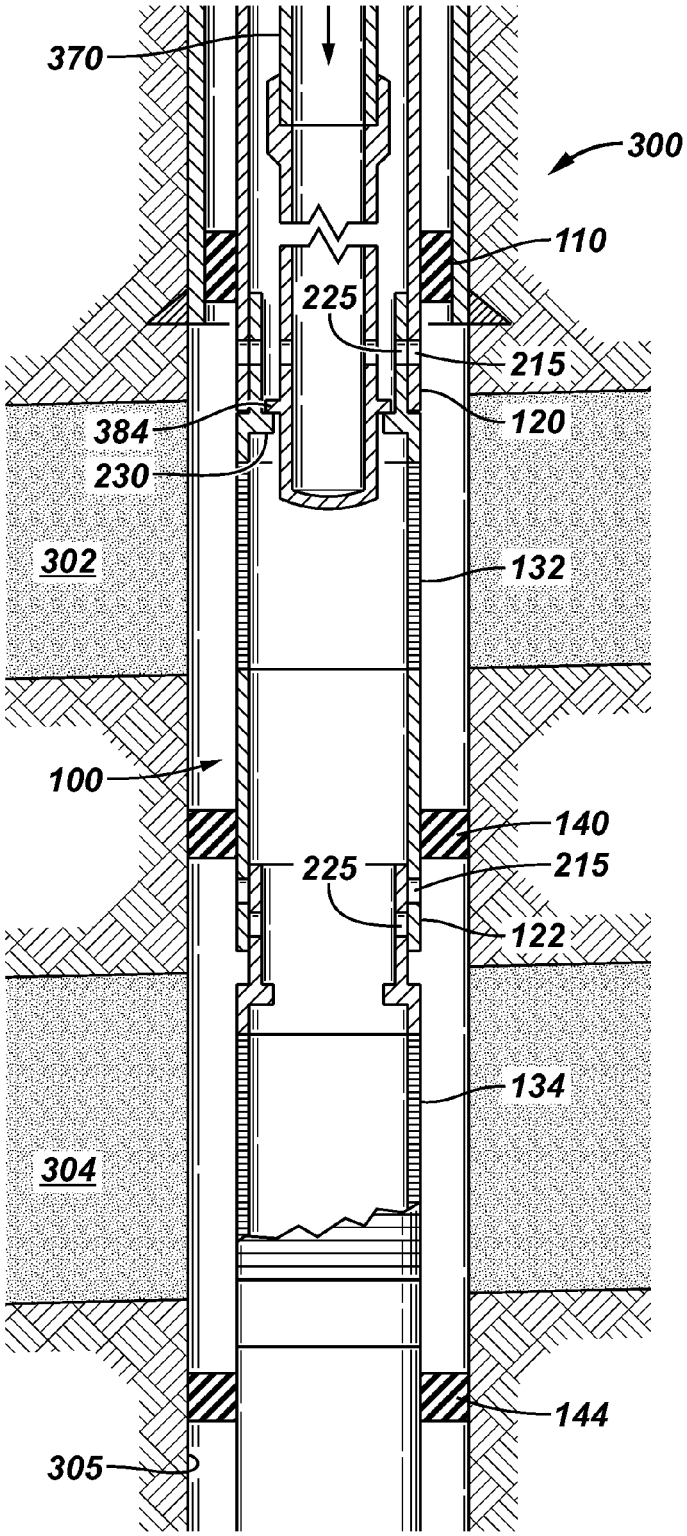

As depicted in FIG. 4, the second hydrocarbon bearing zone 304 is gravel packed, and the second sand control extension 122 is in a closed configuration. The service string 370 is now located adjacent the first sand control extension 120 which is located adjacent the first hydrocarbon bearing zone 302. The stop 384 of the service string 370 is engaged with the set down collar 230 of the first sand control extension 120, which is in an open position. The first hydrocarbon bearing zone 302 is now ready to be gravel packed.

As discussed above, a gravel slurry is transferred through the service string 370, through the aligned ports 215, 225, into the annulus about the first sand control extension 120. The flow of gravel slurry is discontinued after enough of the particulate portion has been disposed in the annulus to at least partially prevent sand commingled with hydrocarbons from being produced, as discussed in U.S. Pat. No. 6,725,929.

Based on the foregoing discussion, it should be readily apparent that the gravel pack assembly 100 increases packing efficiency by reducing the volume in and around the wellbore and hydrocarbon bearing zones. The gravel pack assembly 100 also allows for selective gravel packing, and reduces the risk of bridging between zones. The gravel pack assembly 100 also reduces friction pressure by pumping below or beneath the isolation packers, which are dividing the borehole into multiples, smaller segments.

Furthermore, the gravel pack assembly 100 can be equally adapted to chemically treat or otherwise work-over a borehole, formation, or hydrocarbon bearing zone. One typical treatment is filter cake removal as described in U.S. Pat. No. 6,725,929. The gravel pack assembly 100 allows each zone of interest to be treated selectively while not disturbing another, thereby reducing work over time and rig costs associated with treating zones that do not require such treatment.

Still referring to FIG. 3, production of the hydrocarbons from the hydrocarbon bearing zones 302, 304 can be performed in any manner. In at least one embodiment, the hydrocarbon bearing zones 302, 304 can be selectively produced or commingled. For example, the second hydrocarbon bearing zone 304 can be selectively produced while the first hydrocarbon bearing zone 302 remains isolated. This can be useful when the second hydrocarbon bearing zone 304 has a higher pressure than the first hydrocarbon bearing zone 302. If the pressure differential between the first hydrocarbon bearing zone 302 and the second hydrocarbon bearing zone 304 are the same or substantially the same, such as about a 10 percent or more, about a 5 percent, about a 4 percent, about a 3 percent, about a 2 percent, or about a 1 percent or less pressure differential between the first hydrocarbon bearing zone 302 and the second hydrocarbon bearing zone 304, the two hydrocarbon bearing zones 302, 304 can be produced together or commingled. Likewise, the first hydrocarbon bearing zone 302 can be selectively produced while second hydrocarbon bearing zone 304 the remains isolated. Although not shown, three, four, five, six or seven or more zones can also be independently produced or commingled in some fashion. For example, zones 1, 4, and 5 can be produced will zones 2, 3, 6, and 7 remain isolated. It should be readily apparent that numerous combination and iterations can be used.

Although, the above illustrations discussed a gravel pack assembly configured for gravel packing, treating, and/or producing two or more production zones in a single trip, this should not be taken as a limitation. Instead, the present systems and methods may be practiced in combination with one or more sets of components and/or service tools, including sliding sleeves, flow control valves, inflow control devices, and other oil field tools.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for completing multi-zone, openhole formations, comprising:

locating a gravel pack assembly within an uncased borehole, wherein the gravel pack assembly comprises:

a first sand control extension;

a first sand control screen disposed adjacent the first sand control extension;

a second sand control extension disposed adjacent the first sand control screen;

a second sand control screen disposed adjacent the second sand control extension;

a first isolation packer disposed between the first sand control screen and the second sand control screen;

a second isolation packer disposed between the first isolation packer and the second sand control screen; and a lower seal disposed adjacent the second sand control screen;

positioning the second sand control extension and the second sand control screen at least partially within a second hydrocarbon bearing zone;

positioning the first sand control extension and the first sand control screen at least partially within a first hydrocarbon bearing zone;

setting each of the isolation packers;

pumping a gravel slurry through the second sand control extension to an annulus formed between the gravel pack assembly and a wall of the uncased borehole;

discontinuing the pumping of the gravel slurry to the second sand control extension; and pumping the gravel slurry through the first sand control extension to the annulus.

2. The method of claim 1, wherein the lower seal is an isolation packer.

3. The method of claim 1, wherein pumping gravel slurry through the second sand control extension comprises aligning a means for pumping gravel with the second sand control screen, and wherein discontinuing the pumping of the gravel slurry to the second sand control extension comprises lifting the means for pumping gravel away from the second hydrocarbon bearing zone.

4. The method of claim 1, wherein pumping gravel slurry through the first sand control extension comprises aligning a means for pumping gravel with the first sand control screen, and wherein discontinuing the pumping of the gravel slurry to the first sand control extension comprises lifting the means for pumping gravel away from the first hydrocarbon bearing zone.

5. The method of claim 1, wherein pumping gravel slurry further comprises opening a flowpath through one or more of the sand control extensions, and wherein discontinuing the pumping comprises closing the flowpath through the one or more sand control extensions.

6. The method of claim 1, wherein setting the isolation packers further comprises setting the isolation packers sequentially bottom-up or top-down.

7. The method of claim 1, wherein setting the isolation packers further comprises setting the isolation packers simultaneously.

8. A method for completing multi-zone, openhole formations, comprising:

placing a gravel pack assembly within an uncased borehole, wherein the gravel pack assembly comprises:

a first sand control extension;

a first sand control screen disposed adjacent the first sand control extension; wherein the first sand control extension comprises a first flowpath that is selectively opened and closed;

a second sand control extension disposed adjacent the first sand control screen, wherein the second sand control extension comprises at least a second flowpath that is selectively opened and closed;

a second sand control screen disposed adjacent the second sand control extension;

a first isolation packer disposed between the first sand control screen and the second sand control screen;

a second isolation packer disposed between the first isolation packer and the second sand control screen; and a lower seal disposed adjacent the second sand control screen;

disposing the first sand control extension and the first sand control screen at least partially within a first hydrocarbon bearing zone;

disposing the second sand control extension and the second sand control screen at least partially within a second hydrocarbon bearing zone;

setting each of the isolation packers;

disposing a service string within the gravel pack assembly;

aligning the service string with the second sand control extension;

pumping a gravel slurry through the second flowpath to an annulus formed between the gravel pack assembly and the uncased borehole;

discontinuing the pumping of the gravel slurry to the second sand control extension;

moving the service string away from the second hydrocarbon bearing zone thereby closing the second flowpath;

aligning the service string with the first sand control extension; and pumping the gravel slurry through the first flowpath to the annulus.

9. The method of claim 8, wherein the lower seal is an isolation packer.

10. The method of claim 8, wherein setting the isolation packers further comprises setting the isolation packers sequentially bottom-up or top-down.

11. The method of claim 8, wherein setting the isolation packers further comprises setting the isolation packers simultaneously.

12. The method of claim 8, wherein aligning the service string with the sand control extensions comprises engaging a set down collar.

13. The method of claim 8, further comprising moving the service string towards the surface after pumping gravel to the first sand control extension.

14. The method of claim 13, further comprising closing the first flowpath.

* * * * *